US006483462B2

(12) United States Patent
Weinberger

(10) Patent No.: US 6,483,462 B2
(45) **Date of Patent: *Nov. 19, 2002**

(54) ANTENNA FOR RADIO-OPERATED COMMUNICATION TERMINAL EQUIPMENT

(75) Inventor: Martin Weinberger, Munich (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/491,368

(22) Filed: Jan. 26, 2000

(65) Prior Publication Data

US 2001/0050635 A1 Dec. 13, 2001

(30) Foreign Application Priority Data

Jan. 26, 1999 (DE) ..... 199 03 005

(51) Int. Cl.[7] ..... H01Q 1/38; H01Q 1/24

(52) U.S. Cl. ..... 343/700 MS; 343/702; 343/846

(58) Field of Search ..... 343/700 MS, 702, 343/846, 848; H01Q 1/38, 1/24

(56) References Cited

U.S. PATENT DOCUMENTS

| | | | | | |
|---|---|---|---|---|---|
| 5,262,791 | A | * | 11/1993 | Tsuda et al. | 343/700 MS |
| 5,627,550 | A | * | 5/1997 | Sanad | 343/700 MS |
| 5,896,109 | A | * | 4/1999 | Hachiga et al. | 343/702 |
| 5,926,139 | A | * | 7/1999 | Korisch | 343/702 |
| 5,966,097 | A | * | 10/1999 | Fukasawa et al. | 343/700 MS |
| 6,049,314 | A | * | 4/2000 | Munson et al. | 343/700 MS |
| 6,140,966 | A | * | 10/2000 | Pankinaho | 343/700 MS |

* cited by examiner

*Primary Examiner*—Hoanganh Le
(74) *Attorney, Agent, or Firm*—Bell Boyd & Lloyd LLC

(57) ABSTRACT

The present invention is directed to an antenna for radio-operated communication terminal devices. For effecting a multi-band antenna, a planar inverted-F antenna is provided that is designed in size for a predetermined, lower emission frequency and that includes one or more notchings or graduations in longitudinal direction with which one or more geometrical paths derive over whose course emittable waves form with a higher frequency than the predetermined, lower frequency.

14 Claims, 7 Drawing Sheets

ANTENNA FOR RADIO-OPERATED COMMUNICATION TERMINAL EQUIPMENT

BACKGROUND OF THE INVENTION

1. Field of the Invention

The present invention is directed, generally, to an antenna for radio-operated communication terminal equipment and, more specifically, to a planar inverted-F antenna for covering a number of different frequency bands.

2. Description of the Prior Art.

Particularly in view of developments in mobile radio telephone technology, antennas are required to simultaneously cover a number of frequency bands. Moreover, the marketplace is demanding both smaller and cheaper mobile ratio telephone devices. Antennas are therefore required that have a low space requirement, that can be unproblemmatically designed to function in either a plurality of frequency bands or a broadband frequency range and that can be inexpensively manufactured.

Solutions are known in this field wherein two or more individual planar inverted-F antennas are integrated in a piece of communication terminal equipment. However, one or more feed points are then required which need to be driven via suitable circuitry; thus, representing an additional outlay.

An object of the present invention, therefore, is to specify an antenna for radio-operated communication terminal equipment that is configured as a planar inverted-F antenna which, however, is also in the position of simultaneously covering a plurality of frequency bands.

SUMMARY OF THE INVENTION

An antenna for radio-operated communication terminal equipment for achieving the above-mentioned object is characterized by a planar inverted-F antenna having a feed point and one or more ground connections that is designed for a predetermined, lower emission frequency that has its size defining the overall dimension of the antenna. Such antenna further includes one or more notchings or graduations in longitudinal direction with which one or more geometrical paths derive that are composed of a plurality of straight-line or curved individual paths, and that proceed from the feed point or some other corner or end point to one of the corner points created by the notchings or graduations. Moreover, over the course of such paths an emittable wave is formed with a higher frequency than the predetermined, lower frequency.

The inventive antenna is easy and inexpensive to manufacture, has a small space requirement and can be unproblemmatically designed to function in either a plurality of frequency bands or a broadband frequency range.

Additional features and advantages of the present invention are described in, and will be apparent from, the Detailed Description of the Preferred Embodiments and the Drawings.

DETAILED DESCRIPTION OF THE PREFERRED EMBODIMENTS

Figure 1:
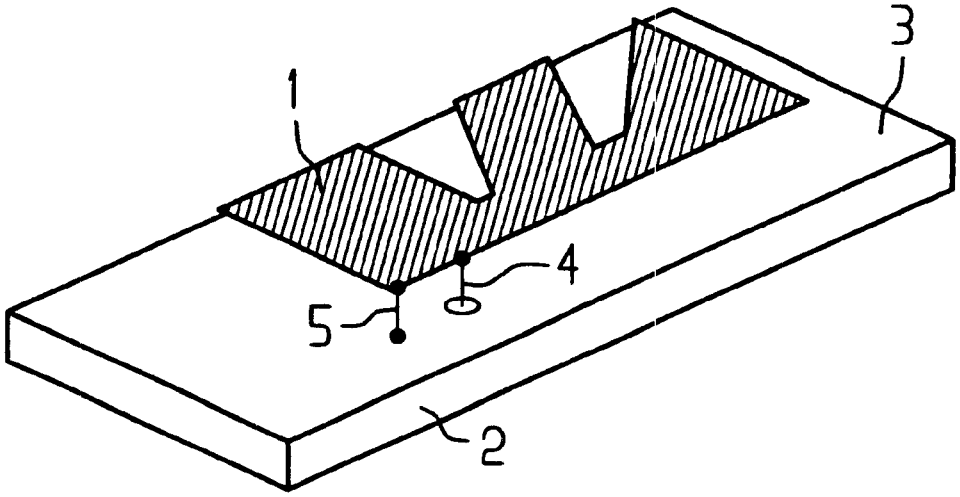
FIG. 1 shows a perspective, schematic view of an embodiment of an antenna according to the present invention.

Reference numeral 1 of FIG. 1 references the actual radiator element of the multi-band antenna according to the present invention, wherein this antenna is a planar inverted-F antenna. Only a part of the housing wall of the mobile radio telephone device 2 is shown, this being coated with a metallic EMC shielding 3. In the present multi-band antenna, this metallic EMC shielding 3 forms the ground needed for the radiator element 1.

The connection between the radiator element 1 and the metallic EMC shielding 3 is produced via the ground connection 5. The actual feed point of the antenna is referenced 4.

An exact explanation of the functioning of the planar inverted-F antenna described here shall not be discussed in detail since this is self-evident to a person skilled in the art of this field. However, let Microstrip Antenna Theory and Design, J. R. James, P. S. Hall, C. Wood, Peter Peregrinus Ltd., Stevenage/UK and New York, 1981, be referenced by way of example in this context.

In addition to the predetermined, lower frequency, a number of higher frequencies derive due to the two notchings undertaken in the radiator element 1 of FIG. 1. The exact course for a part of the waves forming on the radiator element 1 derives form FIG. 14.

FIGS. 2*a* through 2*k* show a small, exemplary selection of differently configured radiator elements. This selection is in no way limiting. All illustrated examples are fundamentally a matter of a planar inverted-F antenna in accordance with the present invention.

Figure 3:
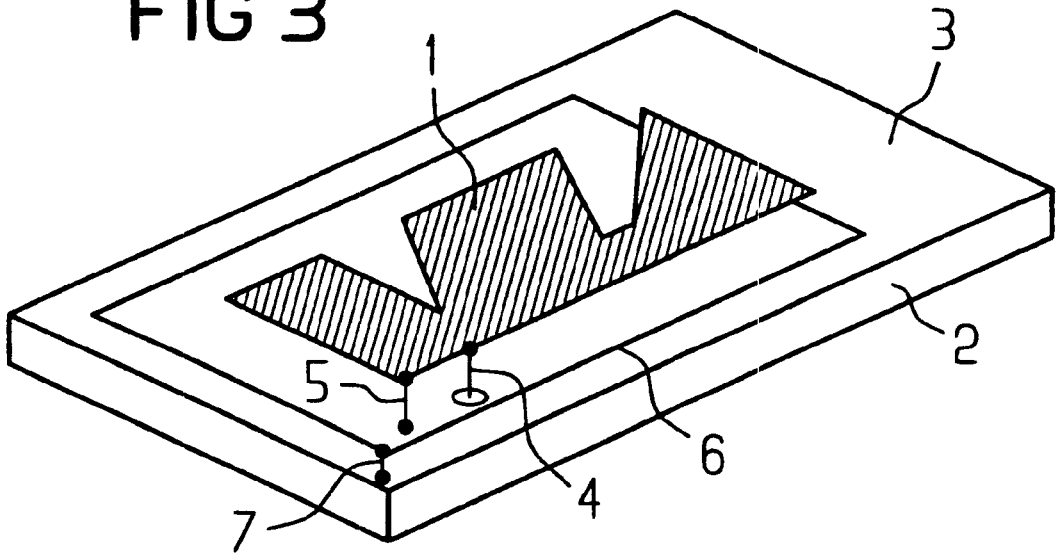
FIG. 3 shows a perspective, schematic view of a possible antenna according to the present invention having a defined, separate ground plate.

FIG. 3 shows an exemplary embodiment of an inventive multi-band antenna that, in contrast to the multi-band antenna shown in FIG. 1, has an additional, separate ground plate 6. Since the ground relationships within a piece of radio-operated communication terminal device cannot always be fully estimated under normal circumstances, the ground plate 6 sees to define ground relationships with reference to the radiator element 1 of the multi-band antenna. One or more connections 7 are provided between the ground plate 6 and the device ground. These connections also can be implemented in planar fashion.

Figure 4:
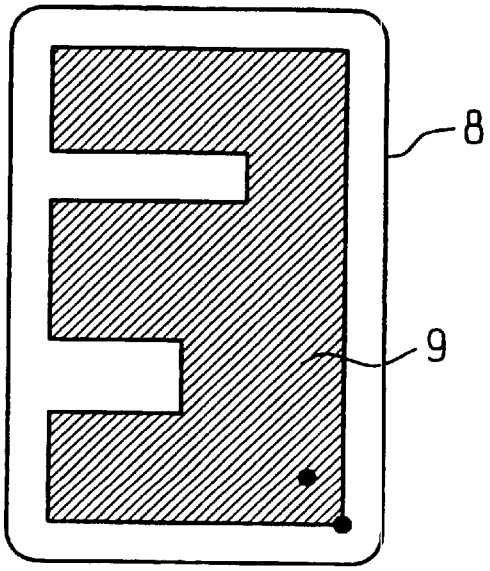
FIG. 4 shows a plan view onto an embodiment of the inventive antenna having an underlying ground plate.
Figure 5:
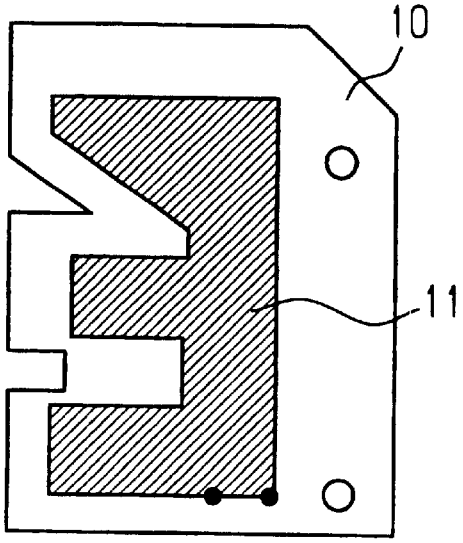
FIG. 5 shows another plan view onto an alternative embodiment of the inventive antenna having an underlying ground plate.

As shown in FIG. 4, the ground plate 8 need not be based on the dimensions of the radiator element 9. However, it is possible to adapt the external dimensions of the ground plate 10 to the respective radiator element 11, as shown in FIG. 5.

Figure 6:
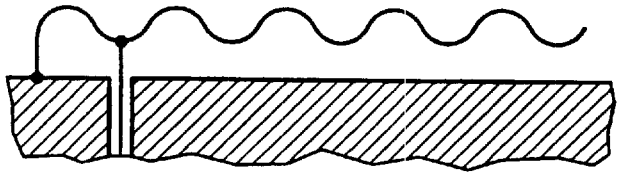
FIG. 6 shows a schematic, sectional view of a shortened antenna of the present invention.
Figure 8:
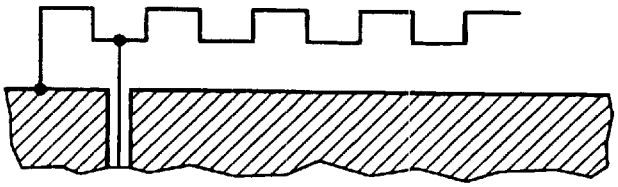
FIG. 8 shows a schematic, sectional view of yet another shortened antenna in accordance with the present invention.

For shortening the structural length of the inventive antenna, the radiator element can be configured in a wave-shape, as shown in FIG. 6, or can be configured rectangularly, as shown in FIG. 8.

Figure 7:
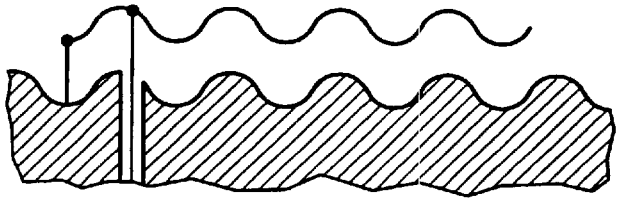
FIG. 7 shows a schematic, sectional view of another shortened antenna in accordance with the present invention.

It is shown by way of example in FIG. 7 that, of course, the ground plate also can adapt to the shape of the radiator element.

Figure 9:
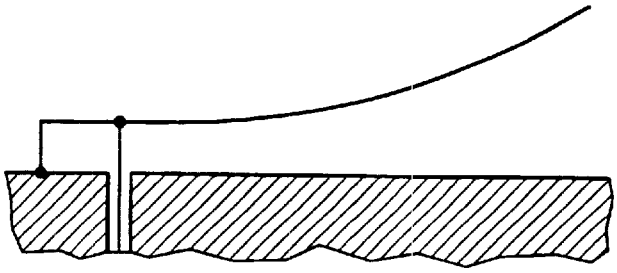
FIGS. 9 through 11 show schematic arrangements of inventive antennas for improving emission properties or for adaptation to housing properties.

For improving emission properties and increasing in bandwidth, it can be provided that the plane of the radiator element of the multi-band antenna not proceed 100% parallel to the metallic EMC shielding of the radio-operated communication terminal device. Rather, a greater distance between the antenna and the metallic EMC layer forms toward the free end. This is shown in FIG. 9.

Figure 10:
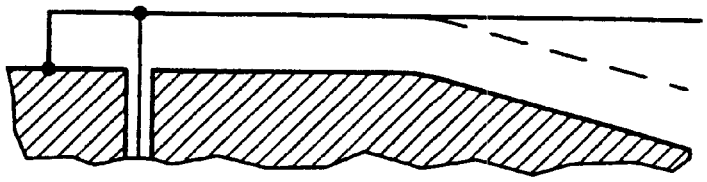
Figure 11:
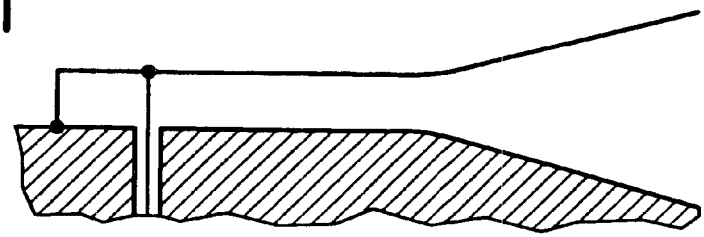

The same problem is shown in FIG. 10, wherein it is assumed that the plane of the radiator element of the multi-band antenna normally adapts to the course of the housing, (shown with broken lines in FIG. 10) but can be continued on a straight line in order to improve emission properties. Another possibility for improving emission properties of the antenna is schematically shown in FIG. 11.

Figure 12:
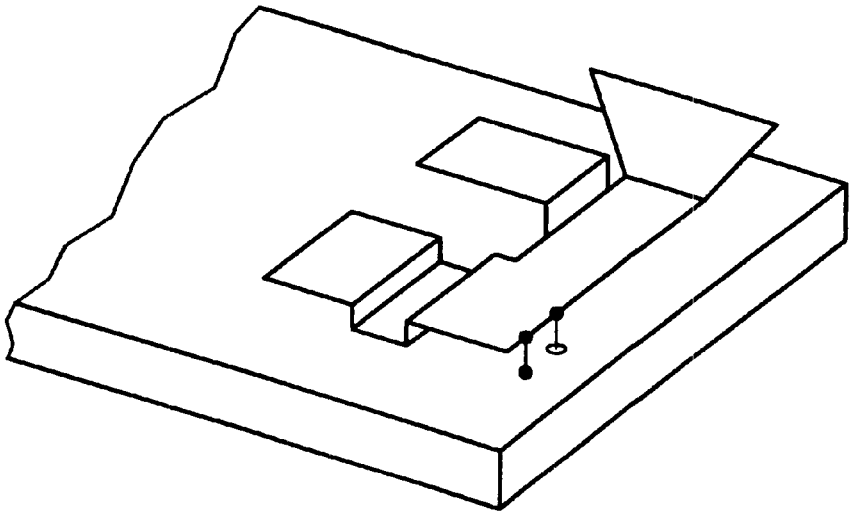
FIG. 12 shows a perspective, schematic view of yet another embodiment of an antenna according to the present invention.

FIG. 12 shows a particular embodiment of the multi-band antenna according to the present invention wherein the radiator element has different heights and slopes.

Figure 13:
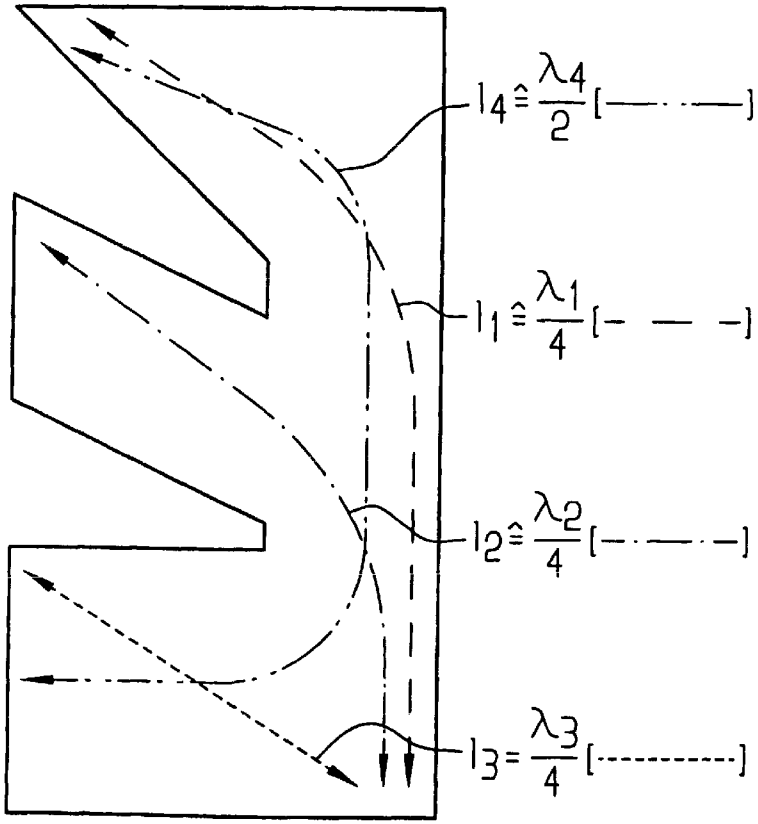
FIG. 13 schematically shows the exemplary wave course given an inventive antenna according to FIG. 1.

Excerpted, FIG. 13 shows the possible wave course given a radiator shape as shown in FIG. 1. It can be seen that, in addition to a fundamental frequency having a wavelength of $\lambda_1$, three further wavelengths form wherein $\lambda_4$ is a matter of a resonant wave between two open ends (i.e., corresponds to a microstrip resonance in the original sense).

Figure 2A:
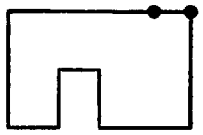
FIGS. 2A through 2K show examples of different embodiments of the radiator elements of further embodiments of an antenna according to the present invention.
Figure 2B:
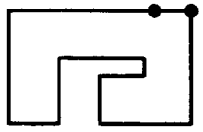
Figure 2C:
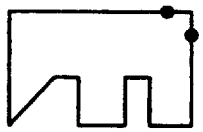
Figure 2D:
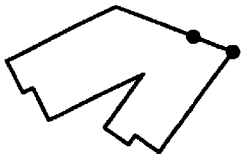
Figure 2E:
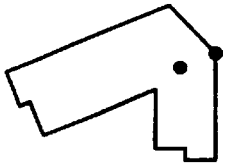
Figure 2F:
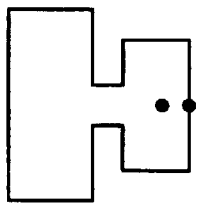
Figure 2G:
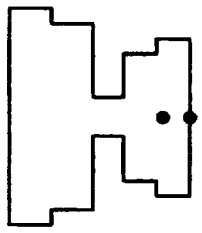
Figure 2H:
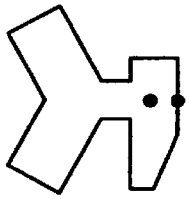
Figure 2I:
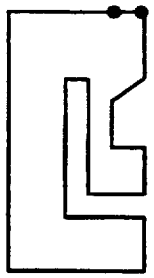
Figure 2J:
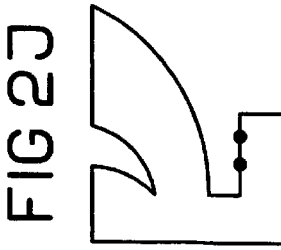
Figure 2K:
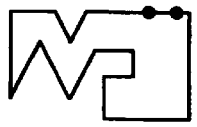
Figure 14:
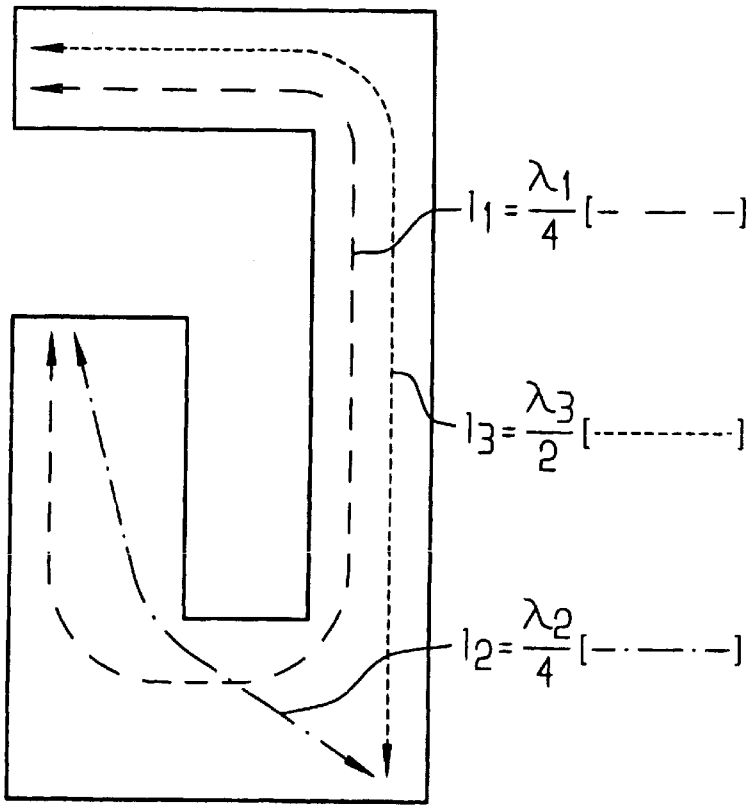
FIG. 14 schematically shows the exemplary wave course given an inventive antenna according to FIG. 2B.

FIG. 14 shows the wave course given a radiator shape as shown in FIG. 2*b*. It can be seen that, in addition to a fundamental frequency having a wavelength of $\lambda_1$, two further wavelengths form wherein $\lambda_3$ is a matter of a resonant wave between two open ends (i.e., corresponds to a microstrip resonance in the original sense).

Figure 15:
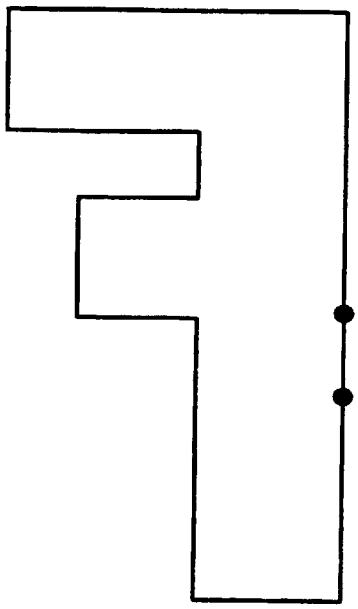
FIGS. 15 and 16 show schematic embodiments with modified positions for one or more structural parts.
Figure 16:
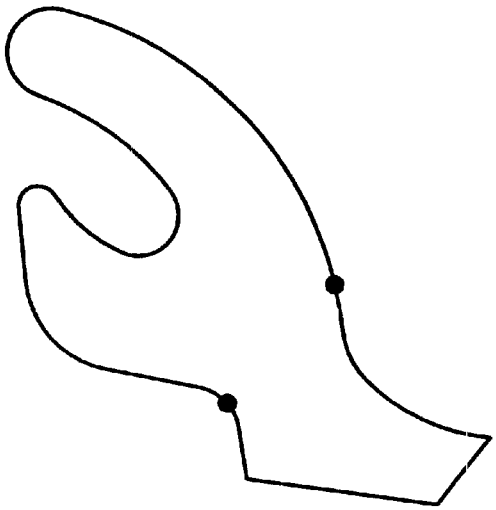

Further, parts of the antenna structure also can be formed in other directions, according to FIGS. 15 and 16, then given the basic shapes. This can be advantageous for the tuning possibilities in individual frequency ranges. The fundamental concept of finding an optimally spatially compact form is thereby violated; thus, however, the givens in the device also can be potentially used better.

It is to be emphasized that the inventive antenna is an inverted-F antenna wherein the lowest radiant frequency is defined by its dimensions and wherein the antenna can be excited to radiate in other, higher frequency ranges on the basis of one or more suitable notchings along its longitudinal axis. The depth and shapes of the notchings can thereby be adapted to the desired properties of the antenna. The antenna acts like the series connection of two or more planar inverted-F antennas wherein some radiator parts are used in common by all. Emissions, as in the case of microstrip antennas (half-wave resonance), also can occur due to transverse resonances between the various radiator parts.

The inventive antenna requires one feed connection and one or more ground connections that can be arbitrarily shaped in order to set potential frequency responses. The connection points for the feed and ground connection indicated in the drawings also can be interchanged and need not necessarily lie at the edge or at a comer of the radiator structure.

The position for the feed and the ground connection also can lie at different sides or edges of the radiator structure. The inventive antenna can have its own ground plate allocated to it, as has been explained in conjunction with FIGS. 3 through 5, or the metallic parts and surfaces of the radio-operated communication terminal device can be used as ground plate. The additional ground surface can thereby be arbitrarily shaped and need not necessarily be adapted to the shape of the radiator element.

The individual parts of the radiator element can exhibit different heights relative to the ground surface produced, for example, by crimping or slopes. For diminishing the dimension in a longitudinal direction, the antenna also can be upset by suitable vertical structuring or can be shortened by suitable folding. The type of folding thereby can be arbitrarily implemented and can be accomplished in various technologies. Thus, only the radiator element or the appertaining ground surface can be correspondingly structured.

By appropriate shaping of the individual radiator elements such as, for example, graduation, slots, tapering, and varying the radiator height over the ground surface, the radiator properties can be further modified or, respectively, improved, or the antenna can be matched to the geometry of the housing.

Further, it should be pointed out that the advantage of the present antenna is that a part of the radiator length that is the defining factor for the lowest frequency also can be used for the emission at higher frequencies. As a result thereof, the area requirement or, respectively, the volume requirement can be kept small. Since an impedance of 50 ohms can be set for all frequency ranges at the single foot point of the antenna, no further external wiring is required.

Since different parts in this antenna contribute to the emission dependent on the frequency range, not all frequency ranges are uniformly disturbed given an inadvertent, partial covering of the antenna with the hand. An existing voice connection, accordingly, potentially can be maintained in an undisturbed frequency range.

Although the present invention has been described with reference to specific embodiments, those of skill in the art will recognize that changes may be made thereto without departing from the spirit and scope of the invention as set forth in the hereafter appended claims.

I claim as my invention:

1. An antenna for radio-operated communication terminal device, comprising:

a single antenna feed point;

at least one ground connection; and a single inverted-F antenna designed for a predetermined, lower emission frequency and connected to both the antenna feed point and the at least one ground connection, wherein a size of the inverted-F antenna determines an overall dimension of the antenna, the inverted-F antenna having a non-planar cross-sectional shape and including at least one notching in longitudinal direction with which at least one geometrical path derives which proceeds from a comer point created by the notchings to a further point selected from the group consisting of the feed point, a further corner point and an end point of the inverted-F antenna, wherein over a course of the at least one geometrical path emittable waves form with a higher frequency than the predetermined, lower emission frequency.

2. An antenna for radio-operated communication terminal devices as claimed in claim 1, wherein a separate ground plate is allocated to the antenna having a variable size and shape.

3. An antenna for radio-operated communication terminal devices as claimed in claim 1, wherein individual parts of radiator elements of the antenna exhibit different heights and slopes.

4. An antenna for radio-operated communication terminal devices as claimed in claim 1, wherein the antenna is upset in at least one of its longitudinal direction and its transverse direction by suitable vertical structuring in a horizontal direction.

5. An antenna for radio-operated communication terminal devices as claimed in claim 1, wherein the antenna is integrated in a housing wall.

6. An antenna for radio-operated communication terminal devices as claimed in claim 1, wherein a position and a type of at least one ground connection between a radiator element and a ground surface of the antenna is adapted to desired antenna properties.

7. An antenna for radio-operated communication terminal devices as claimed in claim 1, wherein a position and a type of a feed connection to a radiator element of the antenna is adapted to desired antenna properties.

8. An antenna for radio-operated communication terminal devices as claimed in claim 1, wherein a position and a type of at least one ground connection between a defined, separate ground surface and a ground surface of the antenna are adapted to desired antenna properties.

9. An antenna for radio-operated communication terminal devices as claimed in claim 1, wherein positions of both a feed connection and the ground connections to an effective antenna ground are interchanged.

10. An antenna for radio-operated communication terminal devices as claimed in claim 1, wherein a feed connection and the ground connection contact a radiator element of the antenna at arbitrary positions.

11. An antenna for radio-operated communication terminal devices as claimed in claim 1, wherein a feed connection and the ground connections do not proceed on a straight line.

12. An antenna for radio-operated communication terminal devices as claimed in claim 1, wherein individual parts of a radiator element of the antenna are shaped such that they point in an arbitrary direction.

13. An antenna for radio-operated communication terminal devices as claimed in claim 1, wherein a radiator element structure of the antenna is divided into a plurality of sub-elements which meet a desired antenna function based on suitable coupling.

14. An antenna for radio-operated communication terminal devices as claimed in claim 1, wherein individual parts of radiator elements of the antenna are arbitrarily curved or folded in a horizontal plane.

* * * * *